United States Patent [19]

Thompson

[11] 4,068,585

[45] Jan. 17, 1978

[54] ELECTROSTATIC PRINTER SUPPORT WITH CONTROLLED ELECTROSTATIC SURFACE VOLTAGE

[75] Inventor: Lester E. Thompson, Los Altos, Calif.

[73] Assignee: ElectroPrint, Inc., Cupertino, Calif.

[21] Appl. No.: 608,940

[22] Filed: Aug. 29, 1975

Related U.S. Application Data

[63] Continuation of Ser. No. 359,287, May 11, 1973, abandoned.

[51] Int. Cl.[2] ..... B41F 15/00; H01T 19/04

[52] U.S. Cl. ..... 101/114; 101/DIG. 13; 250/324; 250/325; 250/326; 427/21; 346/153

[58] Field of Search ..... 101/1 R, 114, 426, DIG. 13; 355/3 R, 3 SC, 16, 17; 427/19, 20, 21; 96/1 A; 346/153, 74 ES; 313/326, 313, 334, 325; 317/262 R, 262 A, 3; 118/620, 621, 624, 637; 250/324–326

[56] References Cited

U.S. PATENT DOCUMENTS

| | | | |
|---|---|---|---|
| 2,916,620 | 12/1959 | Kritchever | 250/324 |
| 3,145,655 | 8/1964 | Hope et al. | 101/DIG. 13 |
| 3,217,330 | 11/1965 | Schwertz | 101/DIG. 13 |
| 3,294,971 | 12/1966 | Von Der Heide | 250/324 |
| 3,308,045 | 3/1967 | Sullivan | 250/325 X |
| 3,405,052 | 9/1968 | Schirmer | 250/324 X |
| 3,460,156 | 8/1969 | Byrd | 250/324 X |
| 3,483,372 | 12/1969 | Benson | 250/326 |
| 3,518,488 | 6/1970 | Michalchik | 250/326 X |
| 3,626,260 | 12/1971 | Kimura | 317/262 A |
| 3,660,656 | 5/1972 | Frank et al. | 250/326 |
| 3,665,856 | 5/1972 | Heller, Jr. | 101/DIG. 13 X |
| 3,680,954 | 8/1972 | Frank | 355/35 C |
| 3,691,375 | 9/1972 | Gawron et al. | 250/325 |
| 3,736,493 | 5/1973 | Rosenthal | 250/324 X |
| 3,739,246 | 6/1973 | Haas | 250/324 |
| 3,769,506 | 10/1973 | Silverberg | 317/262 A |
| 3,789,278 | 1/1974 | Bingham et al. | 317/262 A |
| 3,794,418 | 2/1974 | Makino et al. | 355/3 R |
| 3,797,926 | 3/1974 | Fotland et al. | 355/3 |
| 3,824,010 | 7/1974 | Pressman | 101/DIG. 13 |
| 3,834,301 | 9/1974 | Croquelois et al. | 101/426 X |

*Primary Examiner*—E. H. Eickholt

*Attorney, Agent, or Firm*—Townsend and Townsend

[57] ABSTRACT

A line printing apparatus in which spot patterns of ink or toner particles are formed on a moving paper sheet. A modulator defined by a corona source and an electric shield which has a multiplicity of linearly arranged apertures is spaced from one side of the paper. The voltage at each aperture is individually controlled so that ions from the corona are permitted or prevented from passing through preselected apertures. The passing ions impinge certain particles in a toner particle cloud between the modulator and the one side of the paper sheet. A paper support bar is positioned on the other side of the paper and constructed of an insulator and an elongate electrode is secured to the back side of the insulator and positioned parallel to the aperture array. Lateral sides of the insulator are grounded and a high voltage applied to the electrode results in a high surface voltage on the paper support surface of the insulator which gradually drops off to zero or opposite potential from a maximum along a line aligned with the aperture array to the lateral sides of the insulator. Those toner particles impinged by ions are attracted to the high surface voltage on the insulator and deposited on the side of the sheet facing the modulator to sequentially form spot patterns and generate a line print. In one embodiment, the paper support bar is stationary and the paper sheet slides across its surface. In another embodiment, the paper support bar is a rotatable cylinder, preferably supported by rotatable support cylinders with electrically insulative surfaces.

29 Claims, 11 Drawing Figures

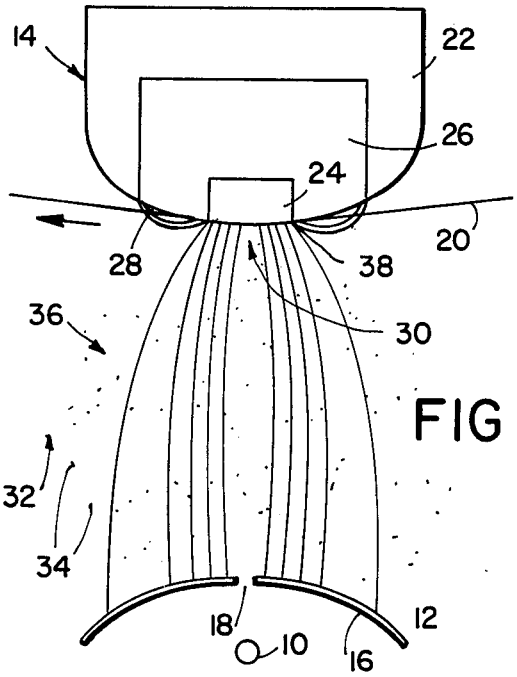
FIG_1
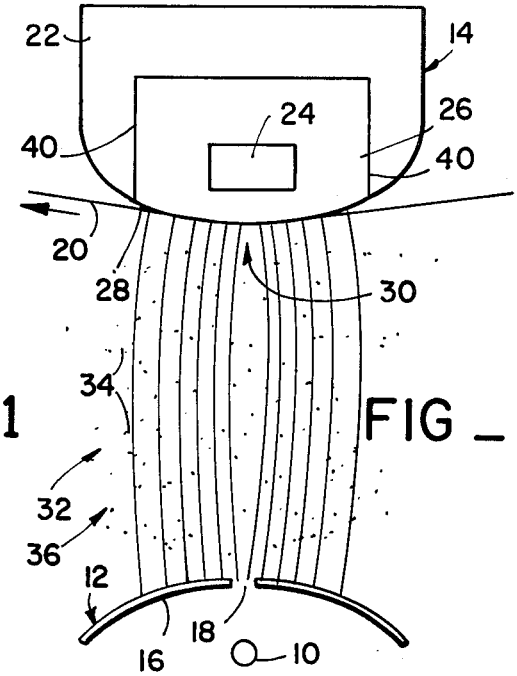
FIG_2
FIG_3
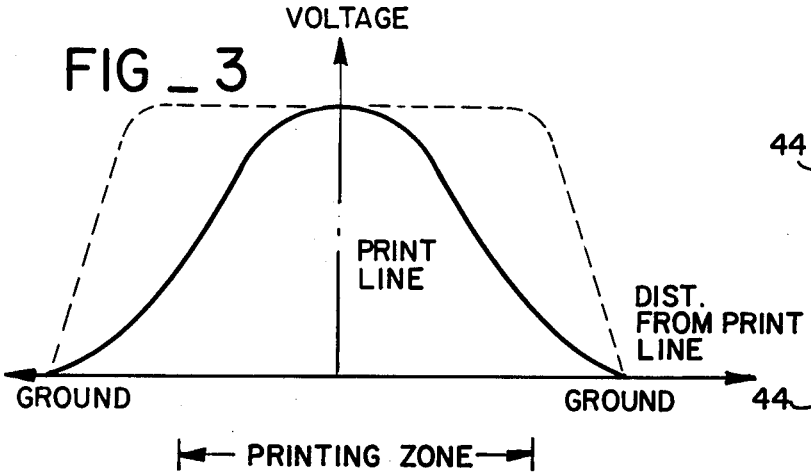
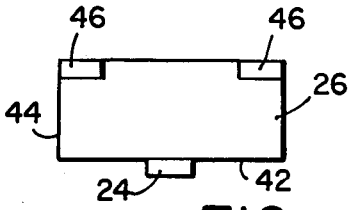
FIG_4
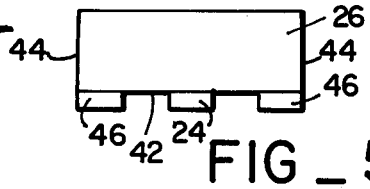
FIG_5
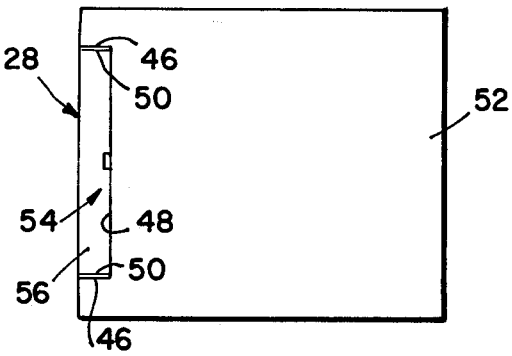
FIG_6
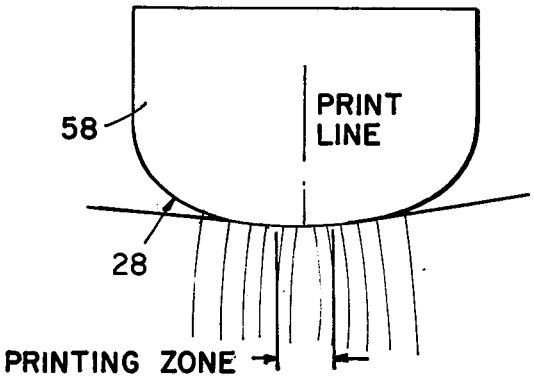
FIG_7

ELECTROSTATIC PRINTER SUPPORT WITH CONTROLLED ELECTROSTATIC SURFACE VOLTAGE

This is a continuation of application Ser. No. 359,287, filed May 11, 1973, now abandoned.

BACKGROUND OF THE INVENTION

Certain advances have recently been made in the field of electrostatic printers which substantially simplify the application of ink or toner particles to a sheet of copy paper or the like. Generally, such electrostatic printers employ a corona source and a spaced electrode for generating a substantially uniform ion stream, and a support for positioning a print receiving medium in the path of the ion stream. A multi-layered apertured two-dimensional screen or line grid modulator is interposed in the ion stream between the source and print receiving medium for modulating the cross-sectional flow density of ions in the stream in accordance with a pattern to be reproduced. A cloud of substantially uncharged toner or marking particles is formed adjacent the print receiving medium whereby the modulated ion stream selectively impinges upon and charges toner particles in the cloud. The selectively charged toner particles adjacent the print receiving medium are thereafter accelerated and deposited on the medium in accordance with the pattern to be reproduced.

Such a system of electrostatic printing is set forth in greater detail in the U.S. patent application Ser. No. 101,681, filed Dec. 28, 1970 for "ELECTROSTATIC PRINTING SYSTEM AND METHOD USING IONS AND TONER PARTICLES", now U.S. Pat. No. 3,779,166 which is assigned to the assignee of the present application. According to the disclosure in the referenced patent application, modulation of the ion flow is accomplished by using a multi-layered apertured element spaced between the ion source and the accelerating electrode. The element has at least a conductive layer and an insulative layer capable of supporting charge potentials of differing magnitude on different layers of the element for establishing electrostatic lines of force within the apertures of the element for controlling passage of ions in accordance with a pattern to be reproduced. Suitable multilayer apertured elements are shown in Pressman U.S. Pat. No. 3,689,935. The corona or ion source and the spaced electrode generate a substantially uniform stream of ions which has a line or linear cross-sectional configuration. The multilayered apertured element is capable of supporting charge potentials of differing magnitude on different layers of the element for establishing electrostatic lines of force within the apertures of the element for controlling passage of ions. The print receiving medium is supported and positioned between the modulating element and the accelerating electrode in the path of the linear ion stream and the print receiving medium is transported across the line cross-section of the ion stream at a given speed.

The cloud of substantially uncharged toner marking particles is between the modulating screen and the print receiving medium and the modulated linear cross-section ion stream selectively impinges upon and charges toner particles in the cloud. Charged particles are accelerated and deposited on the print receiving medium in accordance with the pattern to be reproduced. Normally, a velocity component is imparted to the toner cloud substantially equal to and in the direction of motion of the print receiving medium.

The sharpness or resolution of the spot patterns formed on the medium, say of alphanumeric characters on a sheet of print-out paper, is primarily a function of the voltage difference and of the strength of the electric field between the modulator and the electrode. The stronger the field, the sharper the print-out because toner particles impinged on by ions are more rapidly deposited on the paper and stray less from their straight line path. It appears therefore that the obvious way to improve print-out resolution is to increase the strength of the electric field. To a limited extent, this is possible. However, excessive increases in electrode voltage cause the electrode to form a corona and produce ions with an opposite charge to the charge of the ions emanating from the modulator. The corona and ions generated at the electrode are called secondary corona and secondary ions. The secondary ions travel towards the aperture through the toner cloud. There, they impinge on particles and cause particle movements to the modulator where the particles are deposited. The toner deposit builds up and may clog the apertures of the modulator, which would render the modulator and print-out mechanism inoperative. Thus, increasing the electric field strength to enhance print-out resolution does not ordinarily yield the desired result.

SUMMARY OF THE INVENTION

The present invention is directed to providing a backup electrode that permits higher field strength than the print-out paper as well as providing other advantages for electrostatic printers employing an ion stream through a toner cloud as described, for example, in the above-referenced commonly owned patent application. It will be understood that, as used herein, the term "toner cloud" means and includes wet ink clouds, dry toner particle clouds and/or a mixed cloud. A conveniently constructed backup electrode would have an electric potential which is constant over the full width of the electrode and which abruptly drops off to zero volts along the edges defining the lateral sides of the electrode. The edges cause a high electric field concentration which ionizes the surrounding air and forms the secondary corona and secondary ion discharge. The principle improvement afforded by the present invention is the provision of a backup electrode which defines a paper support surface that extends in both directions from an electronic centerline (hereinafter "print line") aligned with the apertures of the modulator. The electric potential on the support surface is at a maximum at the print line and drops off relatively gradually to ground potential, or an opposite potential at the lateral sides of the support surface. The lower field concentrations produced by this potential reduce the formation of secondary corona.

In accordance with the present invention the above described surface distribution of the surface voltage on the backup electrode supporting the print-out paper can be obtained by placing over the electrode a semiconductor or insulator. The insulator extends to both sides of the print line over a lateral "printing zone". The lateral sides of the insulator are grounded. The insulator defines the support surface for the print-out paper advancing past the print line. When a high potential is applied to the electrode, the electric potential on the support surface is highest along the print line and drops off smoothly over the printing zone to zero volts at the sides of the insulator.

Thus, toner particles in the cloud impinged by ions issuing from the modulator apertures travel at a relatively high speed towards the paper and are directionalized ("focused") into substantial alignment with the print-out line where the electric potential is the highest. The print-out resolution or sharpness is thereby greatly improved. In addition to the advantages offered by the reduction of undesired field concentrations through controlled potential distribution and the "focusing" effect just described, the semiconductor or insulator over the electrode provides further protection against secondary corona and sparking since an insulator will not allow sufficient current to the surface to support an arc or secondary ion discharge.

According to preferred embodiments of the invention the print-out paper support bar is a composite bar comprising a structural member, an electrode and an insulator or semiconductor which forms the paper support surface and covers the electrode. The electrode can be bonded to any one of a number of dielectric materials such as glass, plastic, ceramic or the like. Alternatively, the electrode can be buried in an initially fluid and subsequently hardened material such as an epoxy. The semiconductor material includes ground conductors bonded thereto for contact with the support structure to assure that lateral sides of the electrode are at zero potential when high voltage is applied to the center electrode.

For the proper functioning of the invention the resistivity of the semiconductor material is less than the resistivity of the print-out medium, say paper. In this manner the paper cannot short-circuit the support surface voltage. Concommitantly, the resistivity of the semiconductor must be large enough to both prevent electric currents which would cause an excessive heating of the semiconductor and be high enough to discourage arcing. For use of the invention with conventional computer print-out paper the resistivity is preferably in the range of between about $10^4$ to about $10^{11}$ ohm-cm. Furthermore, the insulator must have a dielectric strength of at least 100 volts per mil to prevent arcing and the like. The semiconductor material must further be homogeneous along the print line direction to maintain a uniform surface voltage over the full length of the paper support surface to eliminate surface voltage variations which would result in variations in the print-out resolution.

In addition to the configuration described above, the insulator or semiconductor may be composed of a geometrical arrangement or combination of different resistivity materials in order to obtain a desired potential distribution resistivity, reduce loading effects of paper resistance, or reduce the current flow through the insulators.

The electrostatic print-out paper support bar of the present invention can be constructed for use in various shapes and forms to satisfy specific design requirements. Although it is preferred to employ a semiconductor, back printing due to secondary ion emission can also be avoided by increasing the width of a conductive backup bar substantially past the print-out zone and gently rounding dthe lateral sides of such a backup bar. Field concentrations and resulting air ionization caused by relatively sharp edges in the vicinity of the print-out zone and consequent toner particle migration to the modulator are then prevented. This approach results in a high electric field across the full width of the support surface, produces a strong field on the modulator in the vicinity of and at points relatively remote from the apertures and can result in arcing. Nevertheless, substantial improvements in the print-out resolution can be obtained without clogging the modulator apertures with toner particles.

BRIEF DESCRIPTION OF THE DRAWINGS

FIG. 1 is a schematic side-elevational view, in section, of a print-out paper support electrode for use with electrostatic printers employing ion streams which may result in the emission of secondary ions;

FIG. 2 is a view similar to FIG. 1 but illustrates the construction of the electrode bar in accordance with the invention to prevent the emission of secondary ions;

FIG. 3 is a diagram illustrating the surface voltage encountered on the support bar illustrated in FIG. 1 and in FIG. 2 in dotted and solid lines, respectively;

FIG. 4 is a cross-sectional elevational view of a semiconductor backup surface constructed in accordance with the invention;

FIG. 5 is a view similar to FIG. 4 but illustrates another construction for the semiconductor;

FIG. 6 is an enlarged cross-sectional view through a print-out paper composite support bar constructed in accordance with the invention;

FIG. 7 is a fragmentary view similar to FIG. 2 and illustrates another embodiment of the invention to eliminate the formation of the secondary ions;

DESCRIPTION OF THE PREFERRED EMBODIMENTS

A. Stationary Backup Bar

Figure 8:
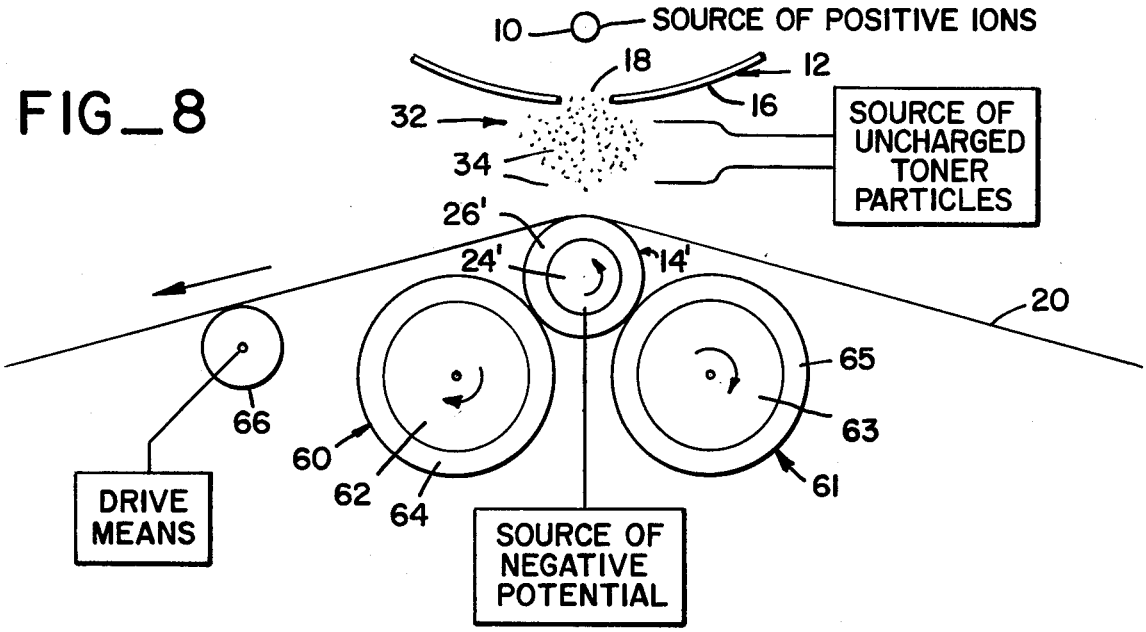
FIG. 8 is a schematic side elevation of an alternate embodiment of a paper support electrode assembly wherein the electrode is in the form of a roller supported from beneath by two other rollers.

Referring to FIGS. 1 and 2, an electrostatic printer of the type disclosed in the above referenced copending patent application broadly comprises a corona source 10, an electric modulator 12 and a paper support bar or backup bar 14. The bar 14 has also been variously referred to as the "platen", "back bar", "semiconductor back bar", and "paper support electrode" in this and other commonly assigned patents and applications. The modulator comprises a multilayered apertured element 16 having a multiplicity of apertures 18 generally linearly arranged along the element 16 which in turn exceeds the width of a printing medium such as a paper strip 20. The element is constructed so that the charge potential at each aperture can be individually controlled. The passage of ions from the corona source through any one of the apertures in the element can thus be controlled.

The composite backup bar 14 has a length greater than the width of paper 20 and is oriented parallel to the array of apertures 18 on element 16. The backup bar is constructed of a structural support member 22, an electrode 24 and a dielectric insulator 26 which mounts the electrode to the support bar and electrically insulates the electrode therefrom. The centerline of the electrode is aligned parallel to the apertures 18 and defines the print line. A gently curved surface of the backup bar facing modulator 12 defines a paper support surface 28. For the purposes of this description a section of the support surface which extends over a limited distance to each side of the print line defines a printing zone 30.

In use, a substantially uncharged toner cloud 32 comprised of miniscule toner particles or ink droplets 34 is introduced into the space 36 between modulator 12 and paper 20. Ions issuing through a modulator aperture 18 travel towards electrode 24 and generally in the plane between the print line and the aperture array of the modulator. The small apertures 18 of the modulator thus each result in a substantially collimated ion stream. The ions issuing from the modulator impinge upon toner particles 34 and charge the particles 34 with a polarity opposite to that of the electrode 24 whereby the impinged particles are accelerated towards the electrode 24. Consequently, the charged toner particles impinge on the side of paper 20 facing the modulator. "Spot" or "dot" patterns corresponding to the modulator apertures are thus deposited across the full line width of the paper. This process is continuously repeated while the paper 20 is translated through the ion flow to sequentially line print on the paper.

As already mentioned, the resolution of the spot pattern, i.e. the degree to which the charged toner particles stray from the center of any given spot pattern, is a function of the magnitude of the electric field of force between the modulator and the electrode. Therefore, the greater the field, the higher the concentration of the toner particles at a given spot on the paper. For optimum resolution it would therefore be desirable to have a high electrode voltage.

When electrode 24 forms part or all of paper support surface 28, as illustrated in FIG. 1, the surface voltage distribution is uniform, that is, the surface voltage of the backup plate is constant at least over the printing zone. At sharp corners 38 of the electrode, there is an electric field concentration which can cause ionization of the air and act as a corona which emits undesirable secondary ions which have an opposite polarity to the ions emitted by corona source 10. Such secondary ions travel towards the modulator, impinge toner particles which are in turn charged and attracted to the modulator 12 where they have numerous adverse effects including that they can clog modulator apertures 18 as described above.

To prevent secondary ionization in accordance with the invention, electrode 24 is recessed from paper support surface 28 and covered by insulator 26 as illustrated in FIG. 2 so that the full paper support surface, at least over the extent of the printing zone 30, is defined by the insulator. A high electric potential applied to the electrode then results in a high surface potential on the support surface of the insulator at the print line, which is desirable to enhance the print-out resolution. However, the surface voltage decreases relatively smoothly and continuously to lateral sides 40 of the insulator. At the insulator sides, the surface voltage is at ground potential or zero voltage, assuming support member 22 to be at ground. Electric field strength concentrations which could result in the ionization of air and the production of secondary ions are thus eliminated while operation at very high potentials along the print line without secondary discharge and clogging of the modulator apertures is possible.

The provision of a semiconductive path between the electrode and ground produces a desirable voltage profile on the paper backup surface for high quality printing. A further feature of the provision of a semiconductor or insulator is its current-limiting or arc-extinguishing characteristic. In the event that a point along the support surface 28 develops excess field intensity this could result in a corona discharge or arc being drawn from the insulator. The high resistivity of the insulator, however, results in an immediate voltage drop at that point thus eliminating the corona or arc at its inception. This "self-extinguishing" characteristic greatly enhances the reliability of the high resolution print-out in accordance with the invention.

Referring now to FIGS. 2–6, specific constructions for the backup bar 14, and in particular for the insulator 26, are described. For ease of manufacture, the insulator preferably has a rectangular cross-section as illustrated in FIGS. 4 and 5. It can be constructed of any material having the required characteristics, that is, having a dielectric strength of at least about 100 volts per mil and a resistivity that is less than the resistivity of the printing medium, e.g. of paper. The insulator and electrode can be pre-assembled by bonding electrode 24 to an underside 42 of the insulator, that is, to the side of the insulator opposite to the side which eventually defines paper support surface 28. To assure proper grounding of sides 44 of the insulator a ground conductor 46 is preferably bonded to the insulator. The position of the ground conductor can be at the side of the insulator opposite from electrode (shown in FIG. 4), on the same side as the electrode (shown in FIG. 5), or directly in contact with the narrow sides of the insulator (shown in FIG. 6). The insulator-electrode assembly is then installed on a suitable support member as by bonding, pressing or clamping the insulator to the support member.

Pre-assembly of the insulator and the electrode and ground conductors is desirable for many applications particularly those where the insulator as well as the support member are relatively high strength material that can be readily processed. In some instances, however, as when the support member 22 is constructed of a brittle, breakable material such as ceramic, it is often impractical to press or clamp the insulator to the support member. For such an application the electrode and ground conductors can be directly affixed to a bottom 48 and sides 50, respectively, of a rectangularly shaped groove 54 of a ceramic bar 52. After the electrodes and conductors have been affixed to the bar, the rectangular groove is filled with a fluid or semi-fluid insulator such as an epoxy 56. The epoxy then defines the paper support surface 28 (and for that purpose the completed bar is thereafter preferably machined to give it the desired curved configuration and necessary surface smoothness). The in situ formation of the insulator as contrasted with the pre-assembly of the insulator with the electrode and the ground conductors does not alter the operation of the device as above described.

Figure 11:
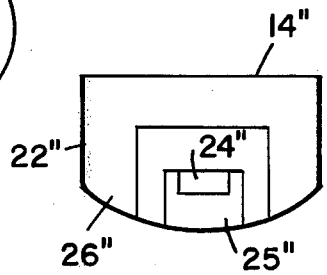
FIG. 11 shows another embodiment of the invention using a composite of different resistivity materials.

FIG. 11 shows an alternative embodiment 14″ of the backbar 14 shown in FIG. 2, wherein all like elements are designated by like numerals (twice primed). As shown, the insulator may be composed of materials with two or more resistivities. In this embodiment, the electrode 24″ is in contact with a first insulator 25″ of one resistivity, and a second insulator 26″ of differing resistivity. Both are carried by support member 22″. Typically the insulator 25″ is of a significantly lower resistivity than the insulator 26″ so that a relatively low resistance exists between the electrode and the printing medium (paper) whereas a relatively high resistance exists between the electrode 24'' and the support member 22'' which is at a much lower potential (typically ground). In this way, the bulk of the current supplied to the electrode 24'' is used to charge the paper and only a small amount flows to the support member 22''. In a typical assembly, the insulator 25'' will have a resistivity of $10^4$ to $10^8$ ohm-cm and insulator 26'' will have a resistivity of $10^9$ ohm-cm or higher.

The electrode 24 (or 24'') can be square, rectangular, round, or any other shape. The insulator 25 (or 25'') can surround the electrode or just contact it. It is not necessary for the insulator 26 (or 26'') to contact the electrode.

Referring now to FIG. 7, in another embodiment of the invention the composite backup bar illustrated in FIGS. 1 and 2 can be replaced with a homogeneous electrically conductive bar 58 that defines paper support surface 28. The homogeneous bar is subjected to an electric potential in the same manner as the electrode illustrated in FIGS. 4–6 is subjected. The ionization of air due to field concentrations at corners of the electrode is prevented, however, by forming the homogeneous bar so that the gently curved portion of the support surface extends substantially past the printing zone. Thereafter, the homogeneous bar is curved to avoid sharp corners and resulting electric field concentrations. In this manner, secondary corona can also be avoided.

B. Roller Backup Bar

A further alternate embodiment of the invention is illustrated at FIG. 8. In this embodiment, a corona ion source 10, multilayer apertured modulator element 12, and composite backup member 14' are all arranged in the same operative relationship as in FIG. 2 wherein like numbers designate the same or equivalent features. As in FIG. 2, the backup member 14' includes an electrode 24' which is embedded in an insulator material 26' which defines a support surface for the paper 20. As in prior embodiments, a substantially uncharged cloud 32 of toner particles 34 is introduced from an appropriate source into the space between the paper 20 and the modulator 12, whereupon a stream of ions passing through the modulator aperture 18 impinges upon the toner particles 34 which become charged and attracted toward the oppositely charged electrode 24, whereupon they are deposited upon the paper 20 in patterns governed by electrical fields in the modulator apertures 18. Control of fields in the apertures is accomplished in accordance with the techniques described in U.S. Ser. No. 101,681, and U.S. Pat. No. 3,689,935 mentioned infra. The principal difference between the embodiment in FIG. 8 and those previously shown herein is the construction of the backup member 14'.

The composite backup member 14' illustrated in FIG. 8 is in the form of an elongate roller having an electrically conductive cylindrical core 24' and a relatively electrically insulative coating or sleeve 26' enclosing the core 24' along its entire length, or at least in the paper support region. Backup roller 14' is supported from beneath by two horizontally spaced parallel rollers 60 and 61, each of which is mounted for rotation about its axis of symmetry which lies parallel to the axis of symmetry of backup roller 14'. Means may be provided for driving one of the rollers 60 or 61 clockwise at a surface speed matching the translational speed of the supported paper 20. Rotational forces are transmitted by friction to the other non-driven support roller and roller 14'. Roller 14' rotates, idler-fashion, in a counterclockwise direction. Alternatively, driving force may be applied to any one of the rollers or any combination thereof, as desired. Preferably, however, all three rollers 14', 60 and 61 are idler mounted and are driven only by frictional engagement of the paper 20 with the surface of the backup roller 14', the paper 20, itself, being driven by a drive roller 66 or the like. Support rollers 60 and 61 are preferably formed with rigid metal central cores 62 and 63 covered by electrically insulative coatings 64 and 65, respectively. Likewise, greater or lesser numbers of support rollers may be employed to support the backup roller 14', as desired.

Backup rollers 14' is preferably about ¼ inch in diameter and the insulative exterior coating 26' is on the order of 1/16 inch thick. The coating is preferably a conducting elastomer which can be a carbon-filled organic plastic material, such as polyethylene. Commercial sources for this material include Technical Wire Products of Cranford, N.J., and Raychem Corp. of Menlo Park, Calif. The coating 26' should have a sufficiently high resistivity to limit current flow to the support rollers 60 and 61. It should also have, as in embodiments discussed previously, a resistivity which is less than the paper 20 or other print receiving media employed to prevent short circuiting. At the same time, it is preferable that the material have a resistivity which is high enough to provide voltage drops of sufficient magnitude to take advantage of the so-called "self-extinguishing" characteristic of the present invention, discussed previously. Yet, the resistivity of the coating 26' should be low enough that, during operation, charge does not build up on the backup roller to cause a reduction in the ion accelerating field. Thus, whereas the operative resistivity range of the coating 26' is on the order of $10^4$ – $10^{11}$ ohm-cm, the preferred range is about $10^5$ – $10^8$ ohm-cm.

Preferably, the exterior coatings 64 and 65 of the support rollers 60 and 61, respectively, are of the same general type of material as the coating 26' on the backup roller 14', but may be several orders of magnitude higher in resistivity in order to reduce currents between 14 and 60 and 61. The rigid cores 62 and 63 of the support rollers can be maintained at zero voltage or biased at a relatively low voltage of opposite polarity from the core 24' of the backup roller 14'. For example, at a preferred operational voltage on the order of 5000 volts applied to core 24' of roller 14', the support rollers might be maintained at potentials in the range of 0 to −1000 volts. The objective in biasing the support rollers is to concentrate field lines of force more sharply on the backup roller 14' without drawing excessive current from the roller 14' via the insulative coatings 26', 64 and 65.

Advantages of the FIG. 8 roller embodiment of the present invention include that it lends itself to inexpensive construction utilizing preferred materials. For example, whereas the insulator 26 of the embodiment shown in FIG. 2 is most economically constructed of phenolic, such material has a resistivity in the upper operational range (e.g. on the order of $10^{10}$ ohm-cm), which limits its operational effectiveness. Conductive elastomers have resistivity factors in the preferred operational range of $10^7$ – $10^8$ ohm-cm. Economic assembly can be achieved by bonding a tube or sleeve of the elastomer on a metal rod, a construction which is economically competitive and operationally superior to the embodiment of FIG. 2. Improved durability is an added advantage. Moreover, it will be appreciated that in the embodiment of FIG. 2, the paper slides across the paper support surface of the electrode, which could tend to build up triboelectric charges on the paper which affect its print receiving characteristics. The roller structure of FIG. 8, by comparison, minimizes triboelectric effects in the printing region by reducing or eliminating relative sliding motion between the paper and the electrode support surface. Similarly, where the rollers are all idler mounted, as is preferred, there will be a degree of startup frictional slippage between the paper and backup roller, but thereafter the backup roller is carried along by the paper at substantially matching surface velocity so that the backup roller and paper will have zero relative velocity at all points of engagement of the paper against the roller surface.

Figure 9:
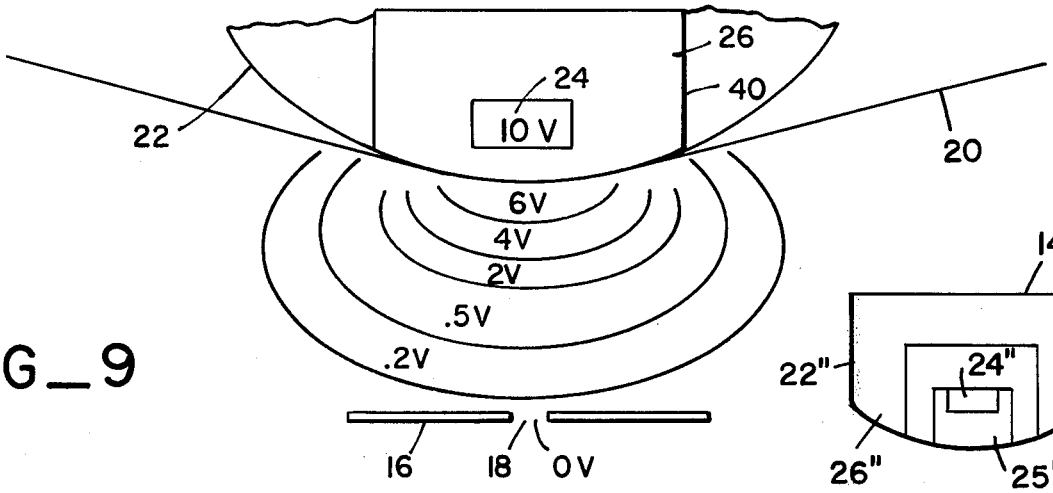
FIG. 9 is an equipotential diagram for a paper support electrode of the type shown in FIG. 2.
Figure 10:
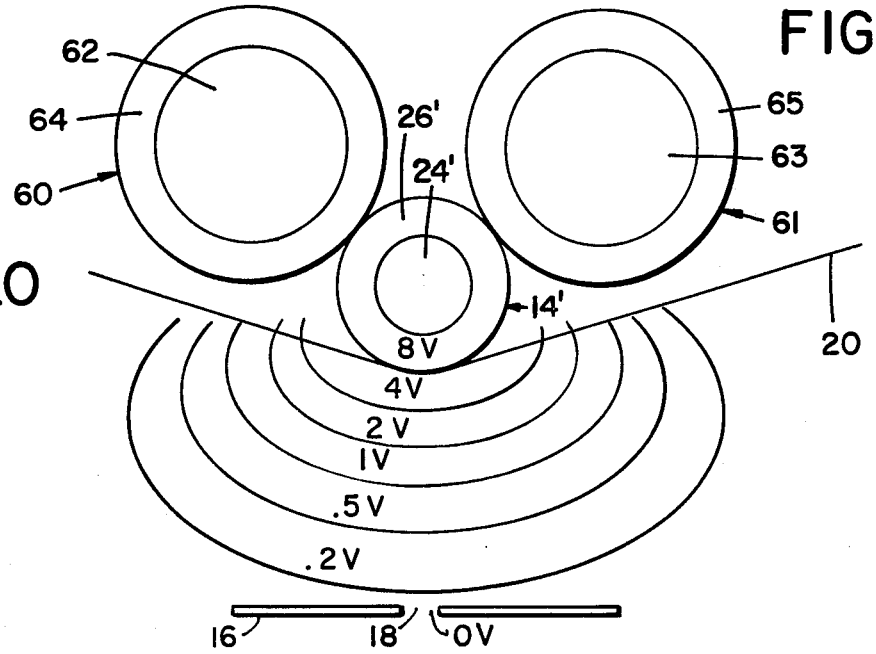
FIG. 10 is an equipotential diagram for the paper support electrode of the type shown in FIG. 8.

FIG. 9 is a representative equipotential plot for a backup bar 14 of the type illustrated in FIG. 2, wherein the electrode 24 is held at 10 volts d.c. It will be noted that the equipotential lines are relatively flat in the central region where particle acceleration occurs. FIG. 10 is a representative equipotential plot for a roller backup bar 14' of the type illustrated at FIG. 8, wherein support rollers 60 and 61 are held at 0 volts d.c. and backup electrode 24' is held at 8 volts d.c. As in FIG. 9, it will be seen that a highly desirable field distribution is established.

The invention has been described in considerable detail with particular reference to certain preferred embodiments thereof, but it will be understood that variations and modifications can be effected without department from the spirit and scope of the invention.

I claim:

1. In a non-contact line printing apparatus of the type having a print receiving medium, a source of charged particles spaced from one side of the medium, an electrode on the other side of the medium to form an electric field in the space between the source and the medium so that charged particles are propelled by the field through space from the source to impinge the medium in a printing zone, and means for electrically modifying the field in accordance with an image to be reproduced, the improvement comprising: semiconductor or insulator means positioned between the electrode and the medium to provide a support surface for the medium and to cause the electric field in the space between the source and the print receiving medium to decrease continuously thoughout the printing zone from a print line in directions at right angles to the print line in the plane of the medium to thereby prevent ionization in the vicinity of the electrode said semiconductor or insulator means surrounding said electrode and being comprised of first and second materials of different resistivity, the first material comprising the portion of said semiconductor or insulator means lying between the electrode and the medium being of a material having a lower resistivity than the second material comprising the portion of the semiconductor or insulator means on the opposed side of the electrode.

2. Apparatus according to claim 1 wherein the semiconductor or insulator means has a resistivity which is less than the resistivity of the print receiving medium.

3. The improvement recited in claim 1 wherein said first and second materials have exposed surfaces facing the print receiving medium, said second material partially surrounding said first element so that the medium-facing-surface of said first material is located between medium-facing-surfaces of said second material.

4. In the improved line printing apparatus recited in claim 3, said semiconductor or insulator means being supported by a support member having medium-facing-surfaces located laterally of the medium-facing-surfaces of said first and second materials, and which is adapted to be maintained at a lower potential, such as ground potential, relative to said electrode.

5. An electrostatic non-contact line printer comprising an elongate source of charged particles, an elongate conductor spaced from and parallel to said source so that a printing medium and an ink marking particle cloud can pass between said source and said conductor, means for establishing an electric field between said elongate source and said elongate conductor to attract said charged particles from said elongate source to said elongate conductor, means for modifying the field in accordance with an image to be reproduced, and discharge prevention means positioned between said source and said conductor for preventing the formation of an electric discharge in the vicinity of the conductor when the conductor is subjected to a relatively high voltage thereby to prevent unintended electrical charging of the ink marking particles by said electric discharge and the resulting attraction of the ink marking particles to said modifying means said discharge prevention means comprised of at least first and second portions, said first portion having a resistivity which is lower than said second portion, said first portion having an exposed paper-facing-surface intersecting the plane including the center-lines of said elongate source of charged particles and said elongate conductor.

6. A printer according to claim 5 wherein said discharge preventing means comprises an insulator in contact with said elongate conductor and positioned between said elongate conductor and the medium.

7. A printer according to claim 5 wherein said elongate conductor comprises an elongate electrode, and wherein said discharge prevention means forms a support surface for the medium and provides an electrical connection between said electrode and a ground.

8. A printer according to claim 5 wherein the medium passes over and contacts said discharge prevention means at least over a printing zone extending transversely to said elongate conductor a limited distance from the center of said elongate conductor to each side thereof, and wherein said discharge prevention means extends substantially past the printing zone so that corona formation at least in the vicinity of the printing zone is prevented.

9. Apparatus for non-contact line printing on an elongate, longitudinally movable strip of material comprising a corona source for the emission of ions, an electric voltage modulator extending over the width of the material on one side thereof, being spaced from the material and including an array of apertures for the selective passage of ions through the apertures, an electrode parallel to the aperture array, extending beyond the material width and located on another side of the material for forming an electric field between said modulator and the electrode whereby a particle mist can be introduced between said modulator and the material and selected ones of the particles impinged by ions passing through the apertures become charged for attraction to and deposition on the material and thereby forming spot patterns on the material, means electrically insulating said electrode from the material, said insulating means having an exterior surface for contacting the material as the material advances longitudinally, said insulating means comprised of first and second high resistivity components of different resistivities, the first component positioned between said electrode and said material, said second component positioned on the opposite side of said conductor and having a higher resistivity than said first component and means forming a voltage on said exterior surface which voltage is highest along a line aligned with the aperture array and which tapers off relatively rapidly and continuously to approximately ground potential at lateral sides of said exterior surface.

10. Apparatus according to claim 9 wherein said insulating means comprises an insulator extending over the length of the electrode and having a width greater than the width of the electrode, and grounding means for grounding a lateral side of said insulating means so that the support surface voltage drops substantially continously from the electrode center to ground potential at said lateral side of said insulating means.

11. Apparatus according to claim 10 wherein said electrode and said grounding means are secured to the insulating means, and including means for positioning said insulating means, said electrode and said grounding means opposite from and parallel to the aperture array of the modulator.

12. Apparatus according to claim 10 wherein said grounding means comprises ground conductors located on opposed lateral sides of said insulating means, laterally spaced from and on each side of the electrode.

13. Apparatus according to claim 9 wherein said insulating means is constructed of substances having lesser resistivity than the material.

14. Apparatus according to claim 13 wherein said substances each have a resistivity of between about $10^4$ to about $10^{11}$ ohm-cm.

15. Apparatus according to claim 13 wherein said substances have a dielectric strength of at least about 100 volts per mil.

16. Apparatus as recited in claim 9 wherein said first component is located on said line aligned with the aperture array.

17. Apparatus according to claim 9 wherein said insulating means has an approximately rectangular cross section, and wherein said electrode is in contact with and centered relative to the sides of said insulating means and opposite said exterior surface.

18. Apparatus according to claim 17 wherein insulating means is provided with a pair of conductors, each disposed parallel to the electrode, spaced therefrom and in contact with the insulating means.

19. Apparatus according to claim 18 wherein said conductors are disposed adjacent longitudinal edges of the sides.

20. Apparatus according to claim 19 wherein said conductors are secured to narrow sides of the insulating means.

21. Apparatus according to claim 19 wherein said conductors are in contact with the side.

22. Line printing apparatus for forming spot patterns of particles on a longitudinally moving sheet paper or the like comprising a modulator including an array of apertures arranged perpendicular to the paper motion and spaced from the paper for selectively passing ions through some of the apertures to thereby charge a particle mist between the aperture array and the sheet and thus form the spot patterns by impinging the charged particles on the paper, and a backup bar on a side of the sheet opposite the array for supporting a portion of the sheet aligned with the array while spot patterns are formed on the sheet, the backup bar being constructed of a material having a lesser electric resistance than the electric resistance of the paper sheet, the backup bar including means for applying a maximum electric potential to a surface portion of the bar contacting the sheet and aligned with the array and for gradually decreasing the potential on the bar to either side of the bar center to prevent high electric field concentrations and the formation of ions in the vicinity of the bar which are attracted to the modulator and which would cause a deposit of particles on the modulator said backup bar comprised of an electrically conductive support member partially enclosing a first semiconductive element which, in turn, partially encloses a second semiconductive element having a lower resistivity than said first semiconductive element.

23. Apparatus according to claim 22 wherein the bar comprises an insulator.

24. Apparatus according to claim 23 wherein the bar is constructed of a glass.

25. Apparatus according to claim 23 wherein the bar is constructed of a ceramic substance.

26. Apparatus according to claim 23 wherein the bar is constructed of a plastic substance.

27. Apparatus according to claim 23 wherein the bar is constructed of an epoxy.

28. Apparatus according to claim 22 wherein said bar comprises a carbon filled polyethylene.

29. Apparatus according to claim 28 wherein said carbon filled polyethylene has a resistivity in the range of about $10^4 - 10^{11}$ ohms/cm.

* * * * *